United States Patent [19]

Bushser

[11] Patent Number: 4,768,353

[45] Date of Patent: Sep. 6, 1988

[54] REFRIGERATION APPARATUS AIR RETURN

[75] Inventor: William J. Bushser, Marrs Township, Posey County, Ind.

[73] Assignee: Whirlpool Corporation, Benton Harbor, Mich.

[21] Appl. No.: 77,639

[22] Filed: Jul. 24, 1987

[51] Int. Cl.[4] ..... F25D 17/04

[52] U.S. Cl. ..... 62/408; 62/419; 62/441; 62/455

[58] Field of Search ..... 62/408, 441, 455, 419

[56] References Cited

U.S. PATENT DOCUMENTS

| | | | |
|---|---|---|---|
| 60,665 | 1/1867 | Banta . | |
| 2,479,866 | 8/1949 | Rosebaugh | 62/92 |
| 2,562,057 | 7/1951 | Norbert et al. | 62/103 |
| 2,563,975 | 8/1951 | Tobey | 62/6 |
| 3,090,209 | 5/1963 | Hubacker | 62/180 |
| 3,111,817 | 11/1963 | Solley, Jr. | 62/283 |
| 3,119,240 | 1/1964 | Dèvery | 62/156 |
| 3,299,664 | 1/1967 | Booth | 62/419 |
| 3,359,750 | 12/1967 | Hanson | 62/156 |
| 3,590,911 | 7/1971 | Horvay | 165/30 |
| 3,834,177 | 9/1974 | Scarlett | 62/288 |
| 3,845,637 | 11/1974 | Shepherd | 62/155 |
| 4,077,229 | 3/1978 | Gelbard et al. | 62/283 |
| 4,211,090 | 7/1980 | Gelbard et al. | 62/283 |
| 4,223,538 | 9/1980 | Braden et al. | 62/443 |
| 4,509,335 | 4/1985 | Griffin et al. | 62/441 X |
| 4,543,799 | 10/1985 | Horvay et al. | 62/283 |

*Primary Examiner*—Lloyd L. King

*Attorney, Agent, or Firm*—Wood, Dalton, Phillips, Mason & Rowe

[57] ABSTRACT

An injection molded plastic air return hood for a refrigerator fresh food compartment provides an angular opening directed away from an air inlet opening for preventing short circuiting of refrigerated air in the compartment. An air return hood is prevented for each air return outlet opening in the compartment and the opening is directed towards a side wall of the compartment. Accordingly, the refrigerated air from the inlet opening must travel a more circuitous path through the refrigerator compartment, thus providing a more thorough refrigeration effect.

17 Claims, 2 Drawing Sheets

REFRIGERATION APPARATUS AIR RETURN

BACKGROUND OF THE INVENTION

1. Field of the Invention

This invention relates generally to refrigerator cabinets, and more particularly, to an air circulation system for providing improved circulation of refrigerated air in the refrigerator cabinet.

2. Description of Background Art

Conventional frostless-type refrigerators utilize forced refrigerated air flow to cool fresh food and freezer compartments. An electric fan draws refrigerated air across an evaporator coil with most of the air being forced into the freezer compartment and then returned to the evaporator. Some of the refrigerated air is delivered to the fresh food compartment through an air inlet opening therein. An adjustable damper may be provided at the air inlet opening and is typically located at the upper central portion of a rear wall in the fresh food compartment. Suitable air return openings are provided for returning air from the fresh food compartment to the evaporator.

One such construction is illustrated in Gelbard et al U.S. Pat. No. 4,077,229. The fresh food compartment includes an air inlet in a back wall thereof offset from the center. A pair of air return outlet openings are positioned on opposite sides of the inlet in a separator wall between the fresh food and freezer compartments. As a result of the proximity between the inlet and the one return opening, it is believed that much of the refrigerated air is "short-circuited" directly to the air return before circulating throughout the refrigerator.

The above described problem is compounded in a relatively narrow refrigerator cabinet, such as a 24 inch wide cabinet, wherein both such air return slots must be located in close proximity to the inlet.

An alternative approach is illustrated in Hanson U.S. Pat. No. 3,359,750, wherein a plurality of air return openings are provided laterally across a forwardly and downwardly facing portion of the separator wall. However, the air inlet is directed to force air in the general direction of the return openings, and therefore it is believed that this construction provides inefficient circulation. Additionally, such a construction would only be utilized where the evaporator coil is located within the separator wall.

The present invention overcomes the above problems of prior refrigerator cabinets, in a novel and simple manner.

SUMMARY OF THE INVENTION

In accordance with the present invention, a refrigeration apparatus is provided with air circulation means for providing improved circulation of refrigerated air in a compartment to be cooled thereby.

Broadly, there is disclosed herein a novel refrigeration apparatus having means for providing refrigerated air, and defining a compartment to be cooled by the refrigerated air. The compartment has opposite substantially parallel side walls. Air circulation means are included for providing improved circulation of the refrigerated air in the compartment, including an air inlet opening to the compartment for delivering refrigerated air from the refrigerated air providing means into the compartment in a general direction substantially parallel to the side wall. An air outlet is spaced from the air inlet for conducting air from the compartment back to the air providing means. The air outlet opens to the compartment at an angle directed toward one of the side walls and away from the air delivery from the air inlet.

The refrigeration apparatus includes an outer shell and an inner liner inwardly from the outer shell. The liner include top, bottom, rear and opposite side walls. An evaporator fan draws refrigerated air across an evaporator coil to provide refrigerated air. A divider partition is secured to the liner rear and side walls for dividing the apparatus into an upper freezer compartment and a lower fresh food compartment, both to be cooled by the refrigerated air. The partition includes a lower wall which defines an upper wall of the fresh food compartment.

An air diffuser located at the center of the rear wall near the upper wall of the fresh food compartment includes an adjustable damper for directing air from the evaporator fan into the fresh food compartment. The diffuser delivers the air into the fresh food compartment in a general direction substantially parallel to the side walls. However, some of the air will be spread into a variety of directions. A pair of air return openings are located at opposite sides of the fresh food compartment upper wall, adjacent the liner side walls, for conducting air from the fresh food compartment back to the evaporator. An air return hood is provided for each of the air return openings. The air return hoods include angular openings, with each hood opening to the compartment at an angle which is directed towards it adjacent side wall and substantially away from the air delivery from the air diffuser. Accordingly, the air return hoods minimize the amount of air which is short circuited directly from the diffuser to the air return openings.

In one embodiment, the air return hoods comprise separate parts which snap into air return openings in the partition. The hood provides an angular opening for its associated return, remote from the diffuser.

Each of the hoods are of identical construction with each hood being located 180° with respect to the other. Thus, each hood directs the opening towards its nearest side wall in the refrigerator compartment.

Further features and advantages of the invention will readily be apparent from the specification and from the drawings.

DETAILED DESCRIPTION OF THE PREFERRED EMBODIMENT

Figure 1:
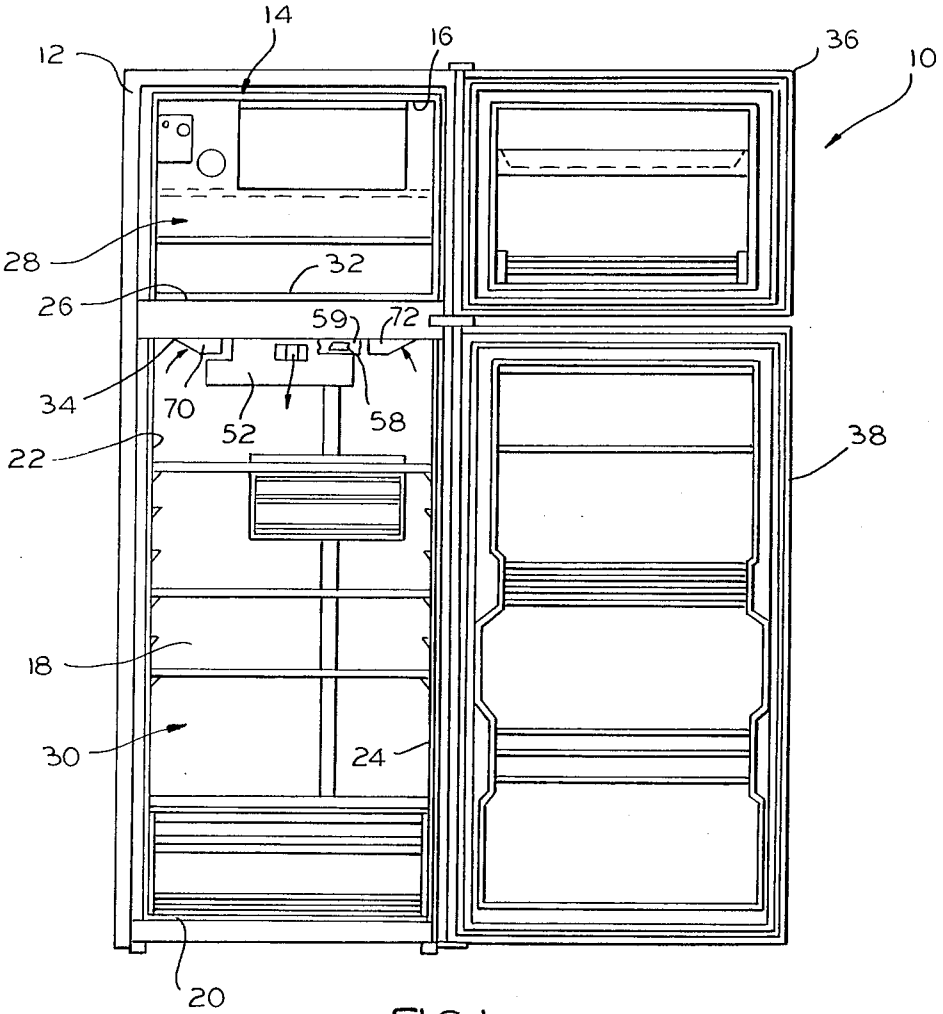
FIG. 1 is a front elevation of a refrigerator/freezer having an air circulation system embodying the invention.

Referring to FIG. 1, a refrigeration apparatus, such as a refrigerator/freezer, 10 include an air circulation system according to the present invention. The invention is shown utilized with a refrigerator/freezer; however, other types of refrigeration apparatus may be used in conjunction with the air circulation system of the present invention, as will be obvious to those skilled in the art.

The refrigerator/freezer 10 includes a cabinet 12 having top, rear and side walls defining an outer shell. A liner 14 is spaced inwardly from the shell 12. The liner 14 includes a top wall 16, a back wall 18, a bottom wall 20, and opposite side walls 22 and 24. A partition 26 divides the cabinets 12 into an upper freezer compartment 28 and a lower fresh food compartment 30. The partition includes spaced apart walls that define a lower wall portion 32 of the freezer compartment 28, and an upper wall portion 34 of the fresh food compartment 30. The freezer compartment 28 is provided with a freezer door 36. Similarly, the fresh food compartment 30 is provided with a fresh food door 38.

Figure 2:
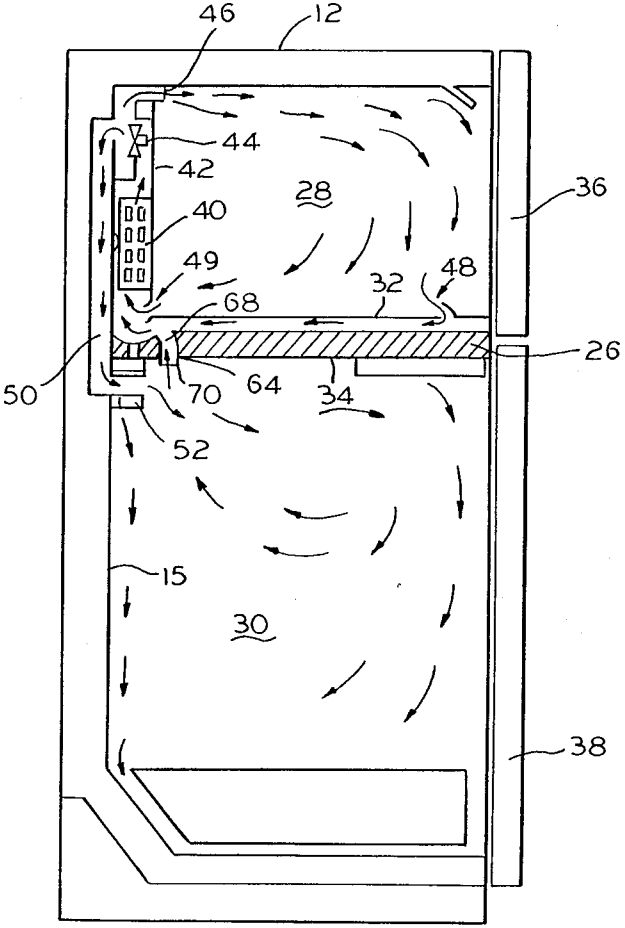
FIG. 2 is a cutaway side view of the refrigerator/-freezer of FIG. 1 illustrating the path of air circulation in the cabinet.

Referring also to FIG. 2, an evaporator coil 40 is provided rearwardly of the freezer compartment 28. A divider wall 42 forwardly of the evaporator coil 40 provides a back wall for the freezer compartment 28. An evaporator fan 44 located above the evaporator coil 40 draws air across the evaporator coil to provide refrigerated air for cooling the compartments 28 and 30.

Suitable openings 46 are provided in an upper portion of the divider wall 42 for delivering refrigerated air from the evaporator fan 44 into the freezer compartment. Suitable openings 48 and 49 are similarly provided in the upper wall 32 of the partition 26 for conducting air from the freezer compartment back to the evaporator coil 40. The arrows in the freezer compartment 28 represent refrigerated air circulation therein.

Figure 3:
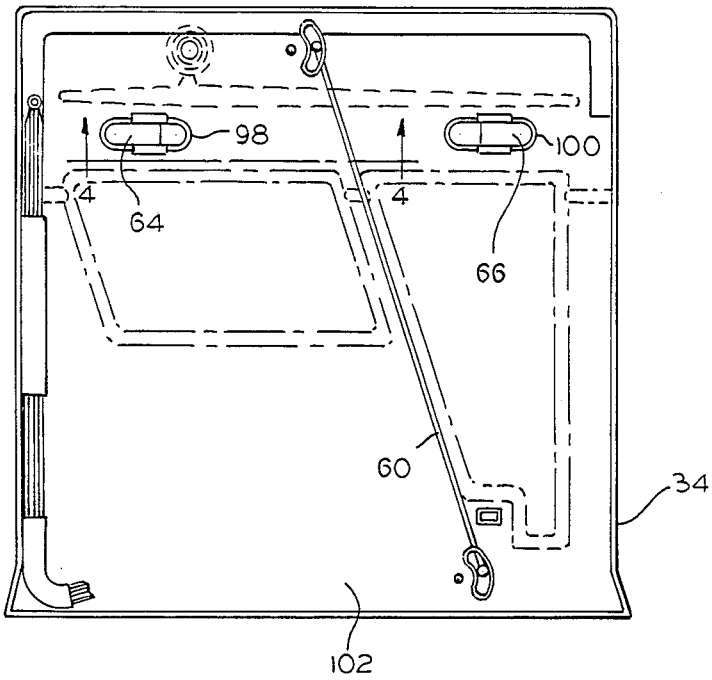
FIG. 3 is a plan view of a portion of a partition divider wall of the refrigerator/freezer of FIG. 1.
Figure 4:
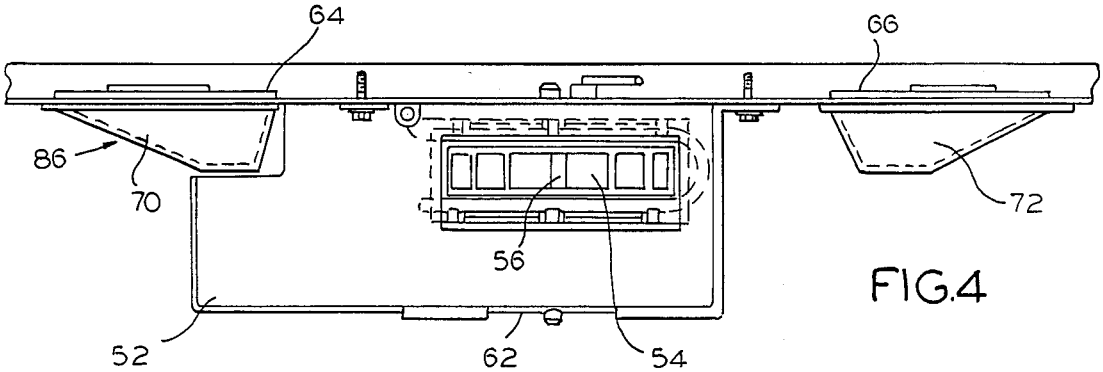
FIG. 4 is a sectional view taken along line 4—4 of FIG. 3.

A passageway 50 forwardly of the rear wall 18 of the liner 14 delivers a portion of the refrigerated air from the evaporator fan 44 to the fresh food compartment 30. The passageway 50 is in communication with an air diffuser 52 centrally located along the rear wall 18 of the liner immediately below the upper wall 34 of the fresh food compartment 30. Referring also to FIGS. 3 and 4, the diffuser 52 includes an air inlet opening 54 for delivering refrigerated air into the fresh food compartment 30. An adjustable damper 56 rearwardly of the opening 54 adjusts the amount of air which is delivered into the fresh food compartment 30. The position of the damper 56 is controlled by a dial 58 in a control panel 59 (partially shown in cut-away) at the front of the fresh food compartment 30. A rod 60 connects the dial 58 to the damper 56. An additional opening 62 is provided in the bottom of the diffuser assembly 52 for delivering a portion of the air downwardly into the fresh food compartment 30. The air inlet openings 54 and 62 deliver refrigerated air into the fresh food compartment 30 in a general direction which is substantially parallel to the side walls 22 and 24. It should be appreciated however, that the diffuser 10 may spread some of the air into a variety of directions.

First and second air return openings 64 and 66, respectively, are provided in the upper wall 34 of the fresh food compartment 30. The return openings 64 and 66 are on opposite sides of the upper wall 34, with each being located laterally between the air inlet opening 54 and their respective adjacent side walls 22 and 24, respectively. The air return openings 64 and 66 conduct air from the fresh food compartment through a passageway 68 (only one is shown in FIG. 2) back to the evaporator coil 40.

First and second hooked air returns 70 and 72, respectively, snap into place over the air return openings 64 and 66, respectively. Each hood 70 and 72 may be, for example, an injection molded part of polyproylene copolymer. The use of such a material provides a somewhat flexible hood which may be snapped into place to secure it to the upper wall 34, as is further described below. Each hook 70 and 72 is identical in construction with one turned 180° relative to the other, as will be described below. As the hooded air returns are identical, only one will be discussed in detail.

Figure 5:
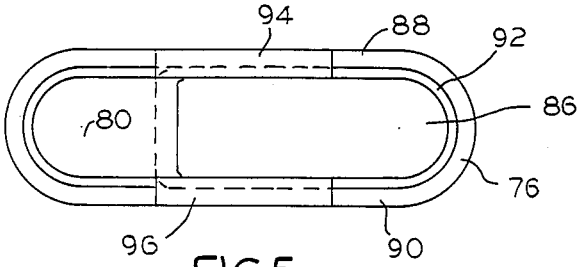
FIG. 5 is a top view of a hooded air return according to the invention.
Figure 7:
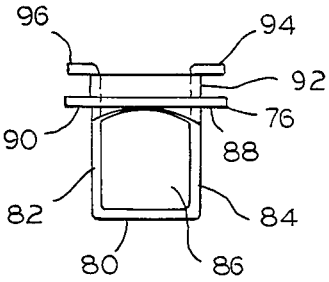
FIG. 7 is a side view of a hooded air return according to the invention.
Figure 6:
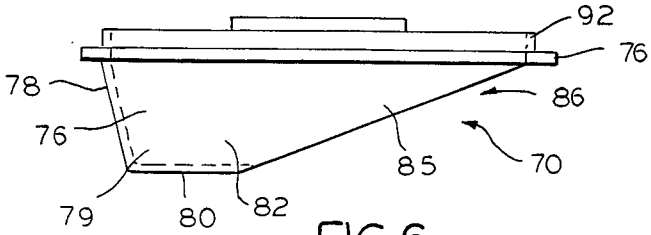
FIG. 6 is a front view of a hooded air return according to the invention.

Referring to FIGS. 5–7, the air return hood 70 includes a substantially U-shaped side wall 74 having an upper flange 76. A closed end 76 of the side wall 74 includes an end wall 78 and side wall sections 82 and 84. A bottom wall 80 extends between the end wall 78 and the side wall sections 82 and 84 to close off the one end 76 of the U-shaped side wall 74. The side wall sections 82 and 84 are angled upwardly from the bottom wall 80 to the flange 76 at an open end 85 of the side wall 74 to define an angular opening 86. The flange 76 is substantially oblong shaped with opposing parallel side portions 88 and 90. A ridge 92 extends upwardly from the flange 76 about its inner periphery. The ridge 92 is sized to fix snugly within the air return openings 64 and 66 of the fresh food compartment upper wall 34. Opposing partial flange portions 94 and 96 extend outwardly from the ridge 92 above the side wall portions 88 and 90, respectively, of the flange 76.

Referring specifically to FIGS. 3 and 4, the hooded air return 70 is snapped into place over the air return opening 64. Upper ridges 98 and 100 are included about the periphery of the air return openings 64 and 66, respectively, on a top side 102 of the upper wall 34. The ridges 98 and 100 are molded as part of the upper wall 34 and add strength at the opening. The flange portions 94 and 96 of the hood 70 lock into place over the ridge 98 to secure the return hood 70 in position over the opening 64. Similarly, the return hood 72 is snapped into place over the return air opening 66 with the flange portions engaging the ridge 100 thereof.

Accordingly, the opening 86 of the hoods 70 and 72 are each open at an angle which is directed toward its adjacent side wall 22 and 24, respectively. Similarly, the openings 86 are directed away from the air delivery from the diffuser opening 54. Thus, the hoods 70 and 72 provide angular openings to the air return openings 64 and 66, respectively at the end of the hood farthest away from the air diffuser inlet opening 54. By placing the hood in the direction described the refrigerated air from the diffuser must travel a more circuitous path through the refrigerator compartment, thus providing a more thorough refrigeration effect. The arrows shown in FIGS. 1 and 2 illustrate the air flow path of the refrigerated air in the fresh food compartment 30 and the freezer compartment 28. The return hoods 70 and 72 accordingly improve the gradient temperature within the fresh food compartment 30 by drawing the return air to more remote corners of the fresh food compartment 30.

It will be appreciated that the return air hoods 70 and 72 could be integrally molded with the upper wall 34 as will be obvious to those skilled in the art. Moreover, the second return air hood 72 and second return opening 66 could be eliminated, thus utilizing only a single air return.

Thus, the invention broadly comprehends an air circulation system for providing improved circulation of refrigerated air in a refrigerated compartment.

The foregoing disclosure of the preferred embodiment is illustrative of the broad inventive concepts comprehended by the invention.

I claim:

1. In a refrigeration apparatus having means for providing refrigerated air, and wall means defining a compartment to be cooled by the refrigerated air, said compartment having opposite end portions, and said wall means defining opposite, substantially parallel sidewalls, air circulation means for providing improved circulation of said refrigerated air through said compartment comprising:

an air inlet opening to said compartment for delivering refrigerated air from said refrigerated air providing means into said compartment to flow through said compartment in a direction substantially parallel to said opposite sidewalls; and an air outlet spaced from said air inlet for conducting air from said one end of the compartment back to said air providing means from an adjacent one of said sidewalls, said air outlet opening to said compartment at an angle directed toward said one of said sidewalls and said other end portion of the compartment, and away from said air delivery into said compartment from the air inlet.

2. The air circulation providing means of claim 1 wherein said air outlet is laterally spaced from said air inlet substantially between said air inlet and one of said side walls.

3. The air circulation providing means of claim 1 wherein said wall means includes an upper wall and said air outlet is located in said upper wall.

4. The air circulation providing means of claim 1 further comprising a second air outlet spaced from said air inlet for conducting air from said compartment back to said air providing means, said second air outlet opening to said compartment at an angle directed towards the other one of said sidewalls and said bottom wall, and away from said air delivery into the compartment from the air inlet.

5. In a refrigeration apparatus having means for providing refrigerated air, and wall means defining a compartment to be cooled by the refrigerated air, said compartment wall means having opposite, substantially parallel sidewalls, a top wall, a bottom wall, and a rear wall, air circulation means for providing improved circulation of refrigerated air in said compartment comprising:

an air inlet opening to said compartment adjacent said top wall for delivering refrigerated air from said refrigerated air providing means into said compartment to flow through said compartment substantially parallel to said opposite sidewalls; and a pair of opposite air outlets at said top wall, one each between said air inlet and each of said sidewalls, for conducting air from said compartment back to said air providing means from adjacent said sidewalls, each said air outlet opening to said compartment at an angle directed toward its adjacent sidewall and said bottom wall and away from the direction of said air delivery into said compartment from said air inlet.

6. The air circulation providing means of claim 5 wherein said air inlet further include an adjustable damper for controlling the amount of refrigerated air delivered to said fresh food compartment.

7. The air circulation providing means of claim 5 wherein said air outlets comprise a pair of air return openings in said top wall and a pair of air return hoods secured to said top wall at said air return opening, said hoods having openings each opening to said compartment at an angle directed towards its adjacent side wall and said bottom wall and away from said air delivery from said inlet.

8. The air circulation providing means of claim 7 including means for snap mounting said air return hoods snap to said top wall over said air return openings.

9. The air circulation providing means of claim 5 wherein said air outlet openings are directed equiangularly toward said sidewalls and away from each other.

10. In a refrigeration apparatus comprising an outer shell, an inner liner spaced inwardly from said shell, said liner having top, bottom, rear and opposite side walls, means for providing refrigerated air, a partition secured to said liner rear and side walls having a lower wall defining an upper wall of a fresh food compartment to be cooled by the refrigerated air, air circulation means for providing improved circulation of refrigerated air in said fresh food compartment comprising:

an air diffuser secured to said fresh food compartment upper wall adjacent said liner rear wall, said diffuser having an opening for delivering refrigerated air from said refrigerated air providing means into said fresh food compartment in a direction substantially parallel to said sidewalls;

first and second air return openings at opposite sides of said fresh food compartment upper wall for conducting air from said fresh food compartment back to said air providing means; and first and second air return hoods secured to said first and second air return openings, respectively, said hoods having angular openings, each opening to said compartment at an angle directed towards its adjacent sidewall and away from said air delivery from said diffuser to prevent short circuiting of refrigerated air flow from said diffuser opening to said air return openings.

11. The air circulation providing means of claim 10 wherein said air diffuser further include an adjustable damper for controlling the amount of refrigerated air which is delivered to said fresh food compartment.

12. The air circulation providing means according to claim 10 wherein said air return hoods snap into place over said air return openings.

13. The air circulation providing means according to claim 10 wherein said first and second air return hoods are of identical construction.

14. The air circulation providing means according to claim 13 wherein said hoods are displaced 180° with respect to one another so that said angular openings thereof are directed away from one another.

15. In a refrigeration apparatus having means for providing refrigerated air, and defining a compartment to be cooled by the refrigerated air, said compartment having an air inlet opening thereto for delivering refrigerated air from said refrigerated air providing means into said compartment, and an air outlet opening laterally spaced from said air inlet for conducting air from said compartment back to said air providing means, an air return baffle comprising:

a substantially oblong-shaped flange;

a substantially U-shaped side wall extending outwardly from said flange;

a partial bottom wall extending across said side wall at a closed end of the U-shaped side wall remote from the flange, said side wall being angled on opposite sides from said partial bottom wall to said flange at an open end of the U-shaped side wall to define a closed end of said baffle and an angularly open end of said baffle; and means associated with said flange for securing said baffle to said air return outlet opening so that said angular opening opens to said compartment at an angle directed toward a side wall thereof and away from said air delivery from the air inlet.

16. The air return baffle of claim 15 wherein said securing means comprises a pair of oppositely and outwardly extending partial flanges for enabling said hooded air return to snap into said air return opening.

17. The air return baffle of claim 15 wherein said baffle is constructed of a material which is somewhat flexible so that the baffle may be snapped into place over said outlet opening.

* * * * *